US008734658B2

(12) United States Patent
Iwata et al.

(10) Patent No.: US 8,734,658 B2
(45) Date of Patent: May 27, 2014

(54) METHOD FOR MANUFACTURING GRAIN-ORIENTED ELECTRICAL STEEL SHEET

(75) Inventors: Keiji Iwata, Tokyo (JP); Yasuhiro Kikuchi, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 0 days.

(21) Appl. No.: 13/805,520

(22) PCT Filed: Jun. 3, 2011

(86) PCT No.: PCT/JP2011/062843

§ 371 (c)(1),
(2), (4) Date: Dec. 19, 2012

(87) PCT Pub. No.: WO2011/162086

PCT Pub. Date: Dec. 29, 2011

(65) Prior Publication Data

US 2013/0092652 A1 Apr. 18, 2013

(30) Foreign Application Priority Data

Jun. 25, 2010 (JP) ..... 2010-145440

(51) Int. Cl.

| | |
|---|---|
| ***B44C 1/22*** | (2006.01) |
| ***C21D 8/12*** | (2006.01) |
| ***C23F 1/02*** | (2006.01) |
| ***C23F 1/14*** | (2006.01) |
| *H01F 1/147* | (2006.01) |

(52) U.S. Cl.

CPC ..... *C21D 8/1294* (2013.01); *C23F 1/02* (2013.01); *H01F 1/14783* (2013.01); *C23F 1/14* (2013.01)

USPC ..... 216/22; 148/306

(58) Field of Classification Search

CPC .... C21D 8/1294; C21D 8/12; H01F 1/14783; H01F 1/16; H01F 19/08; C23F 1/02; C23F 1/14

USPC ..... 148/308, 113, 111, 306, 307; 205/659; 219/121.85; 216/73

See application file for complete search history.

(56) References Cited

U.S. PATENT DOCUMENTS

| | | | |
|---|---|---|---|
| 3,990,923 | A | 11/1976 | Takashina et al. |
| 4,363,677 | A | 12/1982 | Ichiyama et al. |

(Continued)

FOREIGN PATENT DOCUMENTS

| | | |
|---|---|---|
| CN | 1114687 | 1/1996 |
| JP | 50-137819 | 11/1975 |

(Continued)

OTHER PUBLICATIONS

International Search Report dated Aug. 23, 2011, issued in corresponding PCT Application No. PCT/JP2011/062843.

(Continued)

*Primary Examiner* — Duy-Vu Deo
*Assistant Examiner* — Erin Bergner
(74) *Attorney, Agent, or Firm* — Kenyon & Kenyon LLP

(57) ABSTRACT

A resist film is formed on a cold-rolled steel sheet so as to fabricate a groove by etching. At this point, a steel sheet exposed portion where a portion of the steel sheet is exposed is formed in the resist film, and the steel sheet exposed portion has a first region oriented in a sheet width direction, and a plurality of second regions starting from the first region, widths of the first region and the second regions being 20 μm to 100 μm, and a distance from an end portion of one of the second regions to an end portion of another of the second regions adjacent thereto being 60 μm to 570 μm.

3 Claims, 6 Drawing Sheets

(56) References Cited

U.S. PATENT DOCUMENTS

| | | | | | |
|---|---|---|---|---|---|
| 4,655,854 | A | * | 4/1987 | Nishiike et al. | 148/111 |
| 4,770,720 | A | | 9/1988 | Kobayashi et al. | |
| 5,393,355 | A | * | 2/1995 | Nakano et al. | 148/306 |
| 5,413,639 | A | * | 5/1995 | Sato et al. | 148/111 |
| 5,665,455 | A | | 9/1997 | Sato et al. | |

FOREIGN PATENT DOCUMENTS

| | | |
|---|---|---|
| JP | 56-105424 | 8/1981 |
| JP | 61-117218 | 6/1986 |
| JP | 61-253380 | 11/1986 |
| JP | 63-042332 | 2/1988 |
| JP | 4-088121 | 3/1992 |
| JP | 5-121224 | 5/1993 |
| JP | 10-265851 | 10/1998 |
| JP | 2001-316896 | 11/2001 |
| JP | 2007-169762 | 7/2007 |
| WO | 2010/147009 | 12/2010 |

OTHER PUBLICATIONS

International Preliminary Report on Patentability dated Jan. 24, 2013, issued in corresponding PCT Application No. PCT/JP2011/062843.

English translation of the Written Opinion of the International Searching Authority, dated Aug. 23, 2011, issued in corresponding PCT Application No. PCT/JP2011/062843.

Chinese Office Action dated Aug. 2, 2013 issued in corresponding Chinese Application No. 201180031527.5.

* cited by examiner

METHOD FOR MANUFACTURING GRAIN-ORIENTED ELECTRICAL STEEL SHEET

This application is a national stage application of International Application No. PCT/JP2011/062843, filed Jun. 3, 2011, which claims priority to Japanese Application No. 2010-145440, filed Jun. 25, 2010, the content of which is incorporated by reference in its entirety.

TECHNICAL FIELD

The present invention relates to a method for manufacturing a grain-oriented electrical steel sheet where a groove is formed in a surface.

BACKGROUND ART

Grain-oriented electrical steel sheets having an axis of easy magnetization in a rolling direction of a steel sheet are used as an iron core of a power converter such as a transformer. Low core loss characteristics are strongly demanded for an iron core material so as to reduce a loss caused by energy conversion.

As an example of methods for reducing an core loss, there has been proposed a method for reducing an eddy current loss that largely accounts for the core loss by imparting a stress to the surface of a steel sheet or providing a linear groove therein, and thereby subdividing a 180-degree magnetic domain.

However, when the method of imparting the stress to the steel sheet surface is employed, the stress is relieved by heat treatment in a case in which stress-relief annealing is required in assembling a transformer such as a wound iron core. As a result, the eddy current loss reduction effect by subdividing the magnetic domain disappears.

Meanwhile, when the linear groove is physically fabricated in the steel sheet surface, the eddy current loss reduction effect by subdividing the magnetic domain remains even after the stress-relief annealing.

A plurality of methods have been proposed as the method for fabricating the groove in the steel sheet surface, and examples thereof are disclosed in Patent Literatures 1 to 5. However, the techniques disclosed in Patent Literatures 1 to 5 relate to a method for fabricating a simple and continuous linear groove.

Meanwhile, when a groove composed of a main linear groove (referred to as main groove below) and a plurality of sub line-segmented micro grooves (referred to as sub-groove below) branching therefrom is fabricated in the steel sheet surface, more excellent core loss characteristics are obtained as compared to the case in which the simple linear groove is fabricated.

However, the branching grooves as described above cannot be fabricated by directly using the fabrication methods disclosed in Patent Literatures 1 to 5.

That is, when etching is performed to fabricate the branching micro grooves in the steel sheet surface to a depth at which desired core loss characteristics are obtained, an interval between the branching micro grooves becomes smaller. As a result, there occurs a problem that the micro grooves adjacent to each other become continuous to each other, to thereby form a wider main groove.

CITATION LIST

Patent Literature

Patent Literature 1: Japanese Laid-open Patent Publication No. 61-117218

Patent Literature 2: Japanese Laid-open Patent Publication No. 61-253380

Patent Literature 3: Japanese Laid-open Patent Publication No. 63-42332

Patent Literature 4: Japanese Laid-open Patent Publication No. 4-88121

Patent Literature 5: Japanese Laid-open Patent Publication No. 2001-316896

Patent Literature 6: International Publication Pamphlet No. WO2010/147009

SUMMARY OF INVENTION

Technical Problem

It is thus an object of the present invention to provide a method for manufacturing a grain-oriented electrical steel sheet, which enables to appropriately form a groove composed of a main linear groove and sub line-segmented micro grooves branching therefrom by etching.

Solution to Problem

To achieve the above object, the scope of the present invention is as follows.

(1) A method for manufacturing a grain-oriented electrical steel sheet including the steps of: forming a film on one surface or both surfaces of a steel sheet; and performing etching on the steel sheet where the film is formed, wherein a steel sheet exposed portion where a portion of the steel sheet is exposed is formed in the film, and the steel sheet exposed portion has a first region oriented in a sheet width direction, and a plurality of second regions starting from the first region, widths of the first region and the second regions being 20 μm to 100 μm, and a distance from an end portion of one of the second regions to an end portion of another of the second regions adjacent thereto being 60 μm to 570 μm.

(2) The method for manufacturing a grain-oriented electrical steel sheet according to (1), wherein the etching is controlled such that a groove depth of the steel sheet is 10 μm to 30 μm, and an erosion width to a lower portion of the film is 2 to 4.5 times of the groove depth.

(3) The method for manufacturing a grain-oriented electrical steel sheet according to (1), wherein the etching is electrolytic etching, the electrolytic etching being performed by using a sodium chloride aqueous solution having a concentration of 10 mass % to 20 mass % as an etching solution under such conditions that a solution temperature is 40° C. to 50° C., a current density is 0.1 A/cm$^2$ to 10 A/cm$^2$, and an electrolytic time length is 10 s to 500 s.

(4) The method for manufacturing a grain-oriented electrical steel sheet according to (1), wherein the etching is non-electrolytic etching, the non-electrolytic etching being performed by using a ferric chloride aqueous solution having a concentration of 30 mass % to 40 mass % as an etching solution under such conditions that a solution temperature is 40° C. to 50° C., and an immersion time length is 10 min to 25 min.

Advantageous Effects of Invention

The present invention can provide a grain-oriented electrical steel sheet having excellent core loss characteristics without losing a grooving effect even after stress-relief annealing.

DESCRIPTION OF EMBODIMENTS

In the following, the present invention will be described in detail.

The present inventors performed a grooving test by fabricating a groove composed of a main groove and a plurality of sub-grooves branching therefrom by etching in the surface of a cold-rolled steel sheet obtained by cold rolling. In the following, findings obtained from the grooving test and a result thereof will be described.

Figure 1:
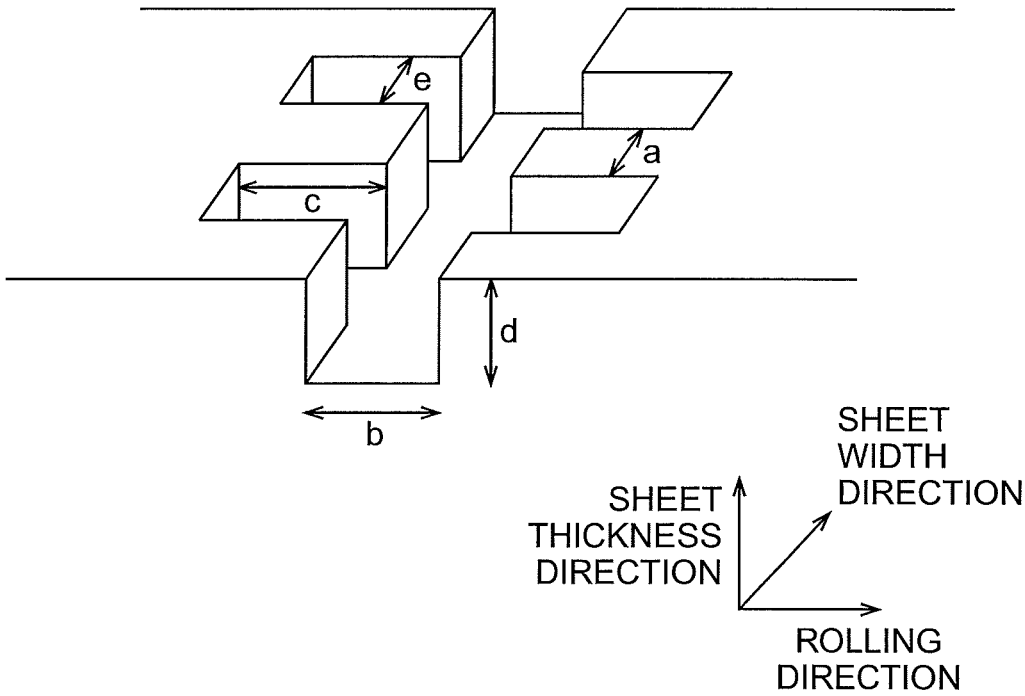
FIG. 1 is a view illustrating an aspect of a groove composed of a main linear groove and a plurality of sub line-segmented micro grooves branching therefrom, which is fabricated in the surface of a steel sheet.

In the grooving test, electrolytic etching was performed by using a photoresist so as to form the branching sub-grooves as shown in FIG. 1 in the surface of the cold-rolled steel sheet. In FIG. 1, an interval a indicates an interval between the branching micro grooves, a groove width b a groove width of the main groove, a groove length c a length of the branching sub-grooves, a groove depth d a depth of the main groove and the sub-grooves, and a groove width e a groove width of the branching sub-grooves.

Figure 2:
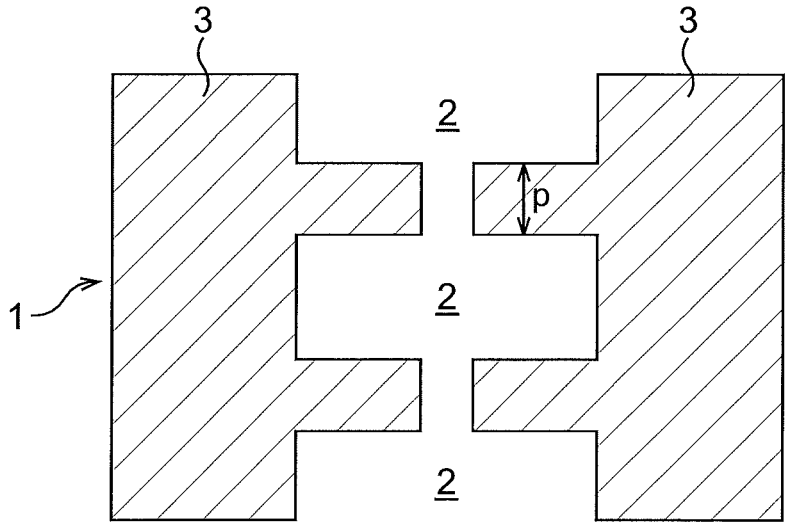
FIG. 2 is a view illustrating a pattern of a resist film formed on the steel sheet surface.

In none of conventional methods for fabricating a linear groove, dimensions of a resist pattern have been specified. Thus, in the present test, a resist film 1 as shown in FIG. 2 was formed so as to etch a portion where the surface of the cold-rolled steel sheet was exposed. In the resist film 1 shown in FIG. 2, a steel sheet exposed portion 2 where the steel sheet is exposed is formed, and the resist film 1 is formed only in a steel sheet non-exposed portion 3.

A NaCl aqueous solution having a concentration of 10 mass % was used as an electrolytic etching solution for use in the etching, and a solution temperature was set to 40° C. Also, a current density was set to 0.3 A/cm$^2$, and an electrolytic time length was changed in a range from 10 s to 500 s to control the groove depth d. A titanium platinum sheet was used as a cathode sheet, and the cold-rolled steel sheet as a material to be etched was attached to an anode side.

To be more specific, the etching was performed on the cold-rolled steel sheet coated with the resist film 1 having a shape as shown in FIG. 2. In the grooving test, a width p of the steel sheet non-exposed portion 3 in the resist film 1 formed before starting the etching was set to 50 μm, and the groove depth d and the interval a of a non-etched portion between the adjacent sub-grooves formed by the etching were measured. A result thereof is shown in FIG. 3.

Figure 3:
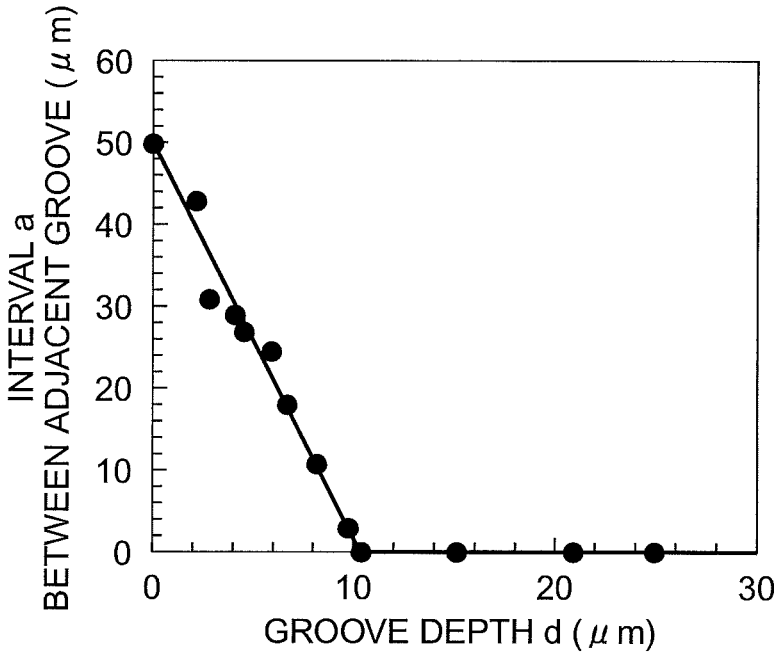
FIG. 3 is a view illustrating the relationship between a groove depth d of a groove and an interval a between adjacent micro grooves formed by etching when a width p of a steel sheet non-exposed portion before starting the etching is 50 μm.

FIG. 3 shows that the interval a between the adjacent sub-grooves decreases as the etching proceeds and the groove depth d thereby increases. This is because the etching is performed to a lower side of the resist film 1.

Also, in the case in which the width p of the steel sheet non-exposed portion 3 is 50 μm, the interval a between the adjacent sub-grooves after the etching becomes 0 when the etching proceeds and the groove depth d exceeds 10 μm. As a result, the plurality of sub-grooves branching from the main groove disappear.

In a grain-oriented electrical steel sheet, coarse Fe—Si single-crystal grains are aligned in one crystal orientation so as to reduce an core loss. Thus, when the cold-rolled steel sheet is etched, anisotropy strongly appears, and particularly, the grooving test has quantitatively proved that erosion in a side direction is larger than expected.

For example, a groove depth at which the core loss of the grain-oriented electrical steel sheet is minimized is 10 μm to 30 μm. However, according to the above findings, a groove having a groove depth of 10 μm to 30 μm cannot be formed in the steel sheet surface merely by performing etching.

Since a simple linear groove is to be formed in conventional cases, there is no problem even if the shape of a resist film for etching is not particularly specified. However, the groove having a groove depth of 10 μm to 30 μm composed of the main groove and the plurality of sub-grooves branching therefrom cannot be formed merely by using the conventional technique as described above.

The present inventors have thus achieved a method for fabricating the groove composed of the main groove and the plurality of sub-grooves branching therefrom in the surface of the cold-rolled steel sheet by precisely specifying the shape of the resist film.

Figure 4A:
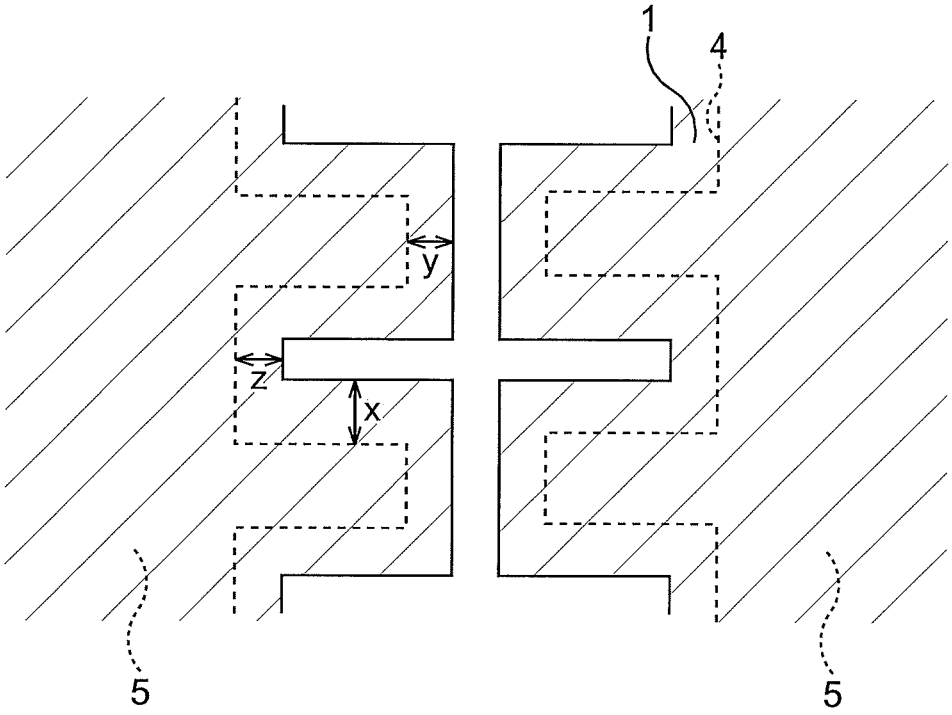
FIG. 4A is a view for explaining respective positions of erosion lengths x, y, and z.
Figure 4B:
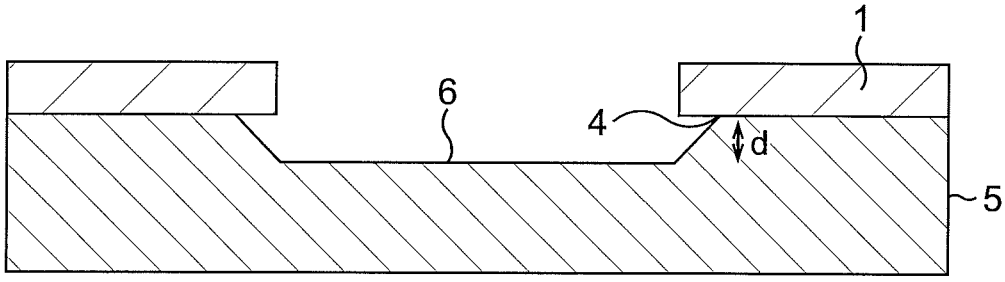
FIG. 4B is a view illustrating a side shape immediately below the resist film as an aspect of a cold-rolled steel sheet after the etching.

The present inventors performed a grooving test in order to examine how far a lower portion of the resist film was eroded by etching. First, as shown in FIGS. 2, 4A, and 4B, a distance from a boundary 4 with a groove 6 formed by the etching at a topmost portion of the surface of a steel sheet 5 after the etching to a boundary between the steel sheet exposed portion 2 and the steel sheet non-exposed portion 3 in the resist film before starting the etching was defined as erosion lengths x, y, and z. Here, the erosion length x indicates an erosion length of the sub-grooves in a sheet width direction, the erosion length y an erosion length of the main groove in a rolling direction, and the erosion length z an erosion length of the sub-grooves in the rolling direction.

In the grooving test, a desired resist film pattern was formed by applying a resist to the surface of the cold-rolled steel sheet, and subjecting the resist to photolithography including steps such as exposure, development, rinsing, and washing. A NaCl aqueous solution having a concentration of 10 mass % was used as the etching solution, and a solution temperature was set to 40° C. Moreover, a titanium platinum sheet was used as a cathode sheet, and the cold-rolled steel sheet as a material to be etched was attached to an anode side to fabricate the groove.

Also, a current density was set to 0.3 A/cm$^2$, and an electrolytic time length was changed in a range from 10 s to 500 s to control the groove depth.

Figure 5:
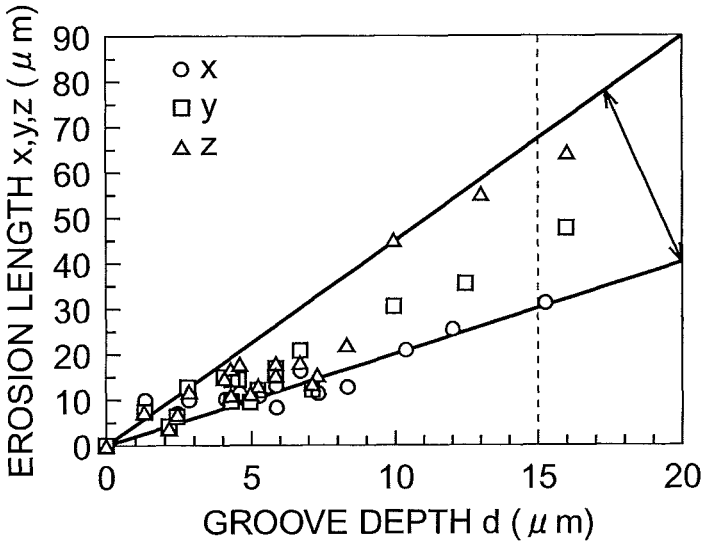
FIG. 5 is a view illustrating the relationship between the erosion lengths x, y, and z, and the groove depth d of the steel sheet.

FIG. 5 shows a result obtained by measuring the erosion lengths x, y, and z and the groove depth d of the steel sheet surface when the etching was performed in a state in which the resist film 1 having the shape as shown in FIG. 2 was formed. The erosion lengths x, y, and z were measured with an optical microscope.

FIG. 5 shows that the erosion lengths x, y, and z are approximately within a range of 30 μm to 67.5 μm, which are respectively within a range of 2 to 4.5 times of the groove depth d, when the groove depth reaches 15 μm. This is considered to be because the erosion lengths differ from each other due to an inhomogeneous electric field or local uneven penetration of the etching solution when the electrolytic etching is performed by applying the resist film to a large steel sheet or the like.

Figure 6A:
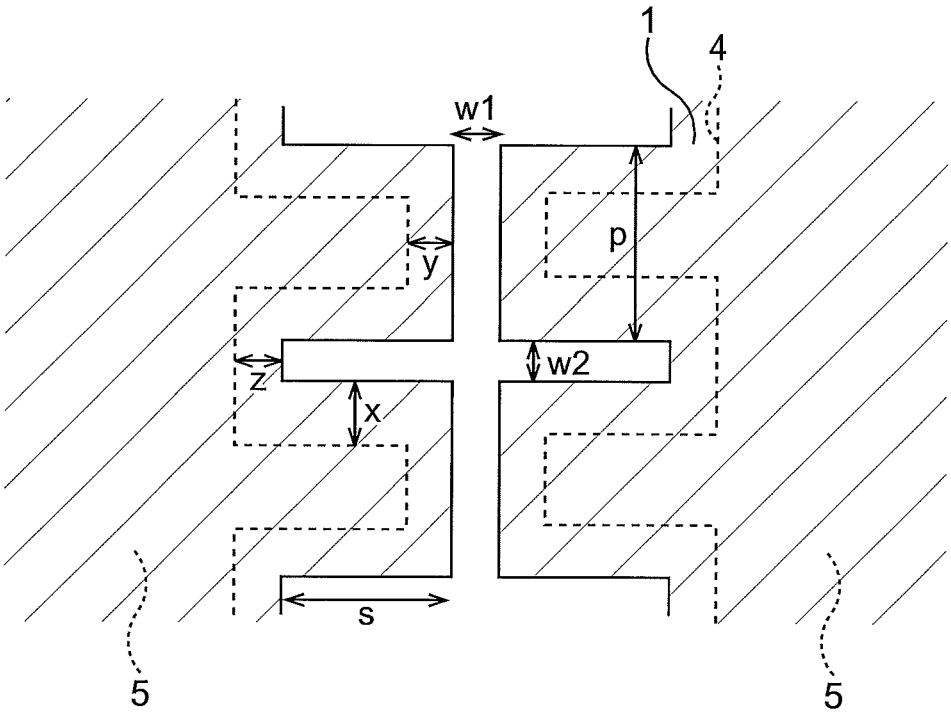
FIG. 6A is a view illustrating a planar shape immediately below the resist film as the aspect of the cold-rolled steel sheet after the etching.
Figure 6B:
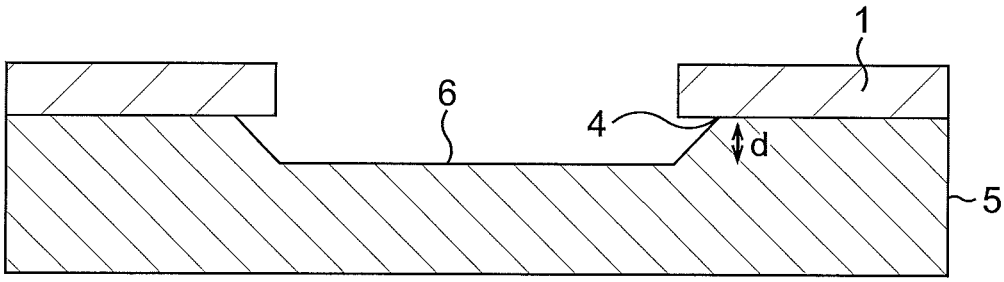
FIG. 6B is a view illustrating the side shape immediately below the resist film as the aspect of the cold-rolled steel sheet after the etching.

FIGS. 6A and 6B show an aspect of the steel sheet after the etching. FIG. 6A shows a planar shape immediately below the resist film. FIG. 6B shows a side shape immediately below the resist film.

The present inventors have found that a favorable result can be obtained when widths w1 and w2 of the steel sheet exposed portion 2 of the resist film 1 are set to 20 μm, the width p of the steel sheet non-exposed portion 3 is set to 150 μm, and a length s in a sub-groove direction of the steel sheet exposed portion 2 is set to 150 μm before starting the etching. The inventors have also found that the erosion lengths x, y, and z respectively become around 50 μm by performing the etching so as to cause the groove depth d to be 15 μm by use of the resist film as described above, and the branching line-segmented sub-grooves whose interval a between the adjacent sub-grooves is 60 μm can be formed even when the groove depth d reaches 15 μm.

As described above, the present inventors have found that the main groove and the sub-grooves can be formed based on a quantitative correlation between the groove depth and the erosion length by etching in the cold-rolled steel sheet having excellent crystallinity and where anisotropy strongly appears by etching. Accordingly, a grain-oriented electrical steel sheet in which excellent core loss characteristics can be maintained without losing a grooving effect even when the steel sheet is subjected to heat treatment such as stress-relief annealing can be provided.

In the following, a method for manufacturing a grain-oriented electrical steel sheet according to an embodiment of the present invention will be described.

First, a slab is fabricated by casting a silicon steel material for the grain-oriented electrical steel sheet having a predetermined composition. Any casting method may be employed. As for components of the silicon steel material, while the advantage of the present invention can be obtained by components of a normal grain-oriented electrical steel sheet, examples of representative components include Si: 2.5 mass % to 4.5 mass %, C: 0.03 mass % to 0.10 mass %, acid-soluble Al: 0.01 mass % to 0.04 mass %, N: 0.003 mass % to 0.015 mass %, Mn: 0.02 mass % to 0.15 mass %, S: 0.003 mass % to 0.05 mass %, with the balance being Fe and inevitable impurities.

After fabricating the slab from the silicon steel material having the composition as described above, the slab is heated. Subsequently, the slab is subjected to hot rolling to thereby obtain a hot-rolled steel sheet. The thickness of the hot-rolled steel sheet is not specifically limited, and for example, may be set to 1.8 mm to 3.5 mm.

After that, the hot-rolled steel sheet is subjected to annealing to thereby obtain an annealed steel sheet. Annealing conditions are not specifically limited, and for example, the annealing is performed at a temperature of 750° C. to 1200° C. for 30 seconds to 10 minutes. Magnetic characteristics are improved by the annealing.

Subsequently, the annealed steel sheet is subjected to cold rolling to thereby obtain a cold-rolled steel sheet. The cold rolling may be performed once, or a plurality of times with intermediate annealing being performed therebetween. The intermediate annealing is performed, for example, at a temperature of 750° C. to 1200° C. for 30 seconds to 10 minutes.

If the cold rolling is performed without performing the intermediate annealing as described above, uniform characteristics may not be obtained. When the cold rolling is performed a plurality of times with the intermediate annealing being performed therebetween, a magnetic flux density may be reduced while the uniform characteristics are easily obtained. Therefore, the number of cold rolling operations and whether or not the intermediate annealing is performed are preferably determined based on characteristics required for the grain-oriented electrical steel sheet to be finally obtained, and a cost.

Next, a resist film is formed on the cold-rolled steel sheet obtained through the procedure as described above, and a groove is fabricated by electrolytic etching or non-electrolytic etching.

For example, a photolithographic technique by a glass mask or a film mask onto which a groove pattern is drawn is used to form the resist film 1 having the shape as shown in FIG. 2 on the steel sheet surface. By using the technique, the steel sheet exposed portion 2 where the steel sheet surface is exposed, and the steel sheet non-exposed portion 3 where the steel sheet surface is not exposed can be formed in the resist film 1. The steel sheet exposed portion 2 is composed of a first region for forming the main groove in the steel sheet, and a second region for forming the sub-grooves therein, and is formed so as to penetrate the resist film 1 in the sheet width direction. Please note that the steel sheet exposed portion 2 may not necessarily penetrate the resist film 1 so as to be parallel to the sheet width direction, and for example, an angle with the sheet width direction is within a range of ±45°.

The widths w1 and w2 of the steel sheet exposed portion 2 in the formed resist film 1 are set to at least 20 μm so as to cause the etching solution to easily penetrate through the steel sheet exposed portion 2.

While the electrolytic etching or the non-electrolytic etching as an industrially easy method is used for the etching, the etching solution may not penetrate through the steel sheet exposed portion 2 if the widths w1 and w2 of the steel sheet exposed portion 2 are too small. Although a method of causing the etching solution to penetrate by use of ultrasonic waves or the like may be employed, there occurs a problem in this case that the resist film is separated.

Meanwhile, if the widths of the steel sheet exposed portion 2 are too large, the etching solution penetrates through the steel sheet exposed portion 2 and the etching proceeds. The branching micro grooves are thereby formed. However, an core loss value of the grain-oriented electrical steel sheet may be increased with an increase in the percentage of an etched portion. According to the grooving test before, it has been proved that the core loss value is not affected when the widths w1 and w2 of the steel sheet exposed portion 2 are 100 μm or less.

Based on the above reasons, the widths w1 and w2 of the steel sheet exposed portion 2 in the resist film 1 before starting the etching are set to 20 μm to 100 μm, and preferably to 40 μm to 80 μm.

Next, specified ranges of the width p of the steel sheet non-exposed portion 3 in the resist film 1 before starting the etching and the groove depth d will be described.

The width of the branching sub-grooves formed in the surface of the electrical steel sheet is preferably set to 20 μm to 300 μm so as to improve the core loss value. Based on the results of the grooving test before, the groove depth is preferably set to 10 μm to 30 μm.

As described above, the erosion lengths x, y, and z are preferably respectively controlled to be within the range of 2 to 4.5 times of the groove depth d. Thus, when the groove depth d is 10 μm, the erosion lengths x, y, and z are at least 20 μm, and erosion may occur to a total of at least 40 μm on both sides of each branching sub-groove.

Meanwhile, when the groove depth d is 30 μm, the erosion lengths x, y, and z are similarly up to 135 μm, and erosion may occur to a total of up to 270 μm on both sides of each branching sub-groove.

Accordingly, in view of forming the branching sub-grooves so as to improve the magnetic characteristics, the width p of the steel sheet non-exposed portion 3 in the resist film 1 is set to 60 μm to 570 μm, and preferably to 60 μm to 400 μm.

As for the length s of the steel sheet exposed portion 2, if the length of the sub-grooves is too large, the cold-rolled steel sheet correspondingly decreases in volume, and the core loss value correspondingly increases. If the length of the sub-grooves is too small, the effect of reducing the core loss value cannot be obtained by providing the sub-grooves as described above. Thus, the length s of the steel sheet exposed portion 2 is preferably set to 100 μm to 500 μm.

Also, an arrangement interval in the rolling direction between one main groove and another main groove adjacent thereto in the cold-rolled steel sheet is preferably set to 1 mm to 10 mm. If the arrangement interval is less than 1 mm, the cold-rolled steel sheet correspondingly decreases in volume, and the core loss value correspondingly increases. If the arrangement interval exceeds 10 mm, diversion of magnetic spin easily occurs with a decrease in the percentage of the sub-grooves. Based on the above reasons, an arrangement interval between a center portion of one steel sheet exposed portion and a center of another steel sheet exposed portion adjacent thereto in the resist film 1 is also preferably set to 1 mm to 10 mm.

The groove depth d of the groove formed by the etching is set, and etching conditions are then determined such that the erosion lengths x, y, and z become 2 to 4.5 times of the groove depth d. The groove having the branching micro grooves can be thereby accurately fabricated. Also, the erosion lengths x, y, and z are more preferably set to 3 to 4 times of the groove depth.

As described above, when the photolithographic technique is used, the width p of the steel sheet non-exposed portion 3 is set by adding twice the value of the erosion lengths x, y, and z to the target interval a between the branching micro grooves, and the groove pattern is thereby drawn onto the glass mask or the film mask.

Figure 7:
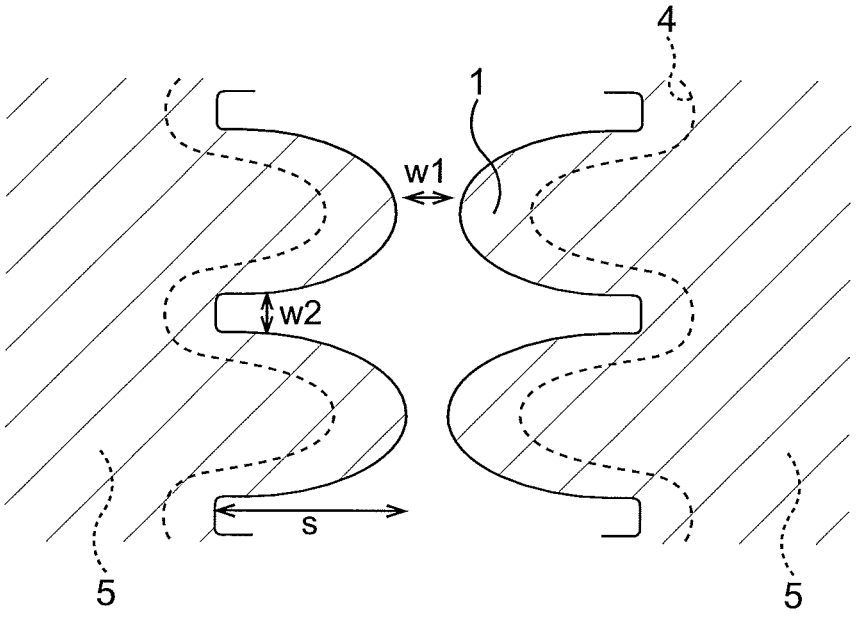
FIG. 7 is a view illustrating another aspect of the steel sheet surface and the resist film after the etching.

FIG. 7 shows another aspect of the steel sheet surface and the resist film after the etching. As shown in FIG. 7, the shape of the resist film may be a pattern separated by a curved line.

Although the dimensional specification of the resist film has been described above, the etching method may be either the electrolytic etching or the non-electrolytic etching. The electrolytic etching is preferably employed since the groove depth can be controlled and an etching rate can be adjusted by controlling a current or a voltage. Also, the non-electrolytic etching is preferably employed since the groove depth can be adjusted based on the type of the solution such as a ferric chloride solution, nitric acid, hydrochloric acid, and mixture solutions with variable compositions, and the solution temperature thereof.

In the electrolytic etching, a sodium chloride aqueous solution having a solution temperature of 40° C. to 50° C. and a concentration of 10 mass % to 20 mass % is preferably used as the etching solution. A current density is preferably set to 0.1 $A/cm^2$ to 10 $A/cm^2$, and an electrolytic time length is preferably set to 10 s to 500 s.

According to the aforementioned grooving test, it has been found that the etching on the cold-rolled steel sheet can be easily caused to proceed by performing the electrolytic etching at the above current density by use of the etching solution having the above solution temperature. The above solution temperature and current density are conditions which can be industrially easily controlled.

The electrolytic time length is set to the range from 10 s to 500 s since the time length is required to set the groove depth d to 10 μm to 30 μm under the above current density conditions.

Also, in the non-electrolytic etching, a ferric chloride aqueous solution having a solution temperature of 40° C. to 50° C. and a concentration of 30 mass % to 40 mass % is preferably used as the etching solution. An immersion time length is preferably set to 10 min to 25 min. The above immersion time length is required to set the groove depth d to 10 μm to 30 μm. The conditions are conditions which can be industrially easily controlled, and are thus more preferably employed.

After the groove is fabricated in the cold-rolled steel sheet through the procedure as described above, the cold-rolled steel sheet is immersed in an alkaline solution to separate the resist film. Subsequently, the cold-rolled steel sheet is subjected to decarburization annealing to thereby obtain a decarburization-annealed steel sheet so as to remove C contained in the cold-rolled steel sheet and cause primary recrystallization. At this point, nitriding annealing may be performed at the same time as the decarburization annealing, or after the decarburization annealing so as to increase an N content in the steel sheet.

In the case of decarburization nitriding annealing in which the decarburization annealing and the nitriding annealing are performed at the same time, the decarburization nitriding annealing is performed in a wet atmosphere containing hydrogen, nitrogen, and water vapor, and further containing a gas with nitriding capacity such as ammonia. The decarburization and the nitriding are performed at the same time in the atmosphere to obtain a steel sheet structure and composition suitable for secondary recrystallization. The decarburization nitriding annealing at this point is performed, for example, at a temperature of 800° C. to 950° C.

Also, in the case in which the decarburization annealing and the nitriding annealing are sequentially performed, the decarburization annealing is performed first in a wet atmosphere containing hydrogen, nitrogen, and water vapor. After that, the nitriding annealing is performed in an atmosphere containing hydrogen, nitrogen, and water vapor, and further containing a gas with nitriding capacity such as ammonia. At this point, the decarburization annealing is performed, for example, at a temperature of 800° C. to 950° C., and the nitriding annealing thereafter is performed, for example, at a temperature of 700° C. to 850° C.

Subsequently, an annealing separator containing MgO as a main component is applied to the surface of the decarburization-annealed steel sheet by a water slurry, and the decarburization-annealed steel sheet is reeled into a coil. The coiled decarburization-annealed steel sheet is subjected to batch-type finish annealing to thereby obtain a coiled finish-annealed steel sheet. Secondary recrystallization occurs by the finish annealing, and a glass film is also formed on the surface of the finish-annealed steel sheet.

After that, the steel sheet is cleaned by light pickling, rinsing with water, brushing or the like, and an insulating film agent containing, for example, phosphate and colloidal silica as main components is applied thereto and baked. A grain-oriented electrical steel sheet product with an insulating film is thereby obtained.

Although it has been described that the object to be etched is the cold-rolled steel sheet as an intermediate of the grain-oriented electrical steel sheet, the object to be etched may be the decarburization-annealed steel sheet obtained after the decarburization annealing. The object to be etched may be also an iron-based magnetic alloy sheet mainly containing Si, Al, Ni, Co or the like as elements other than iron. Moreover, the iron-based magnetic alloy sheet may be a single crystal sheet or a poly-crystal sheet.

EXAMPLE

Although examples of the present invention will be described below, conditions employed in the examples are merely one condition example employed so as to confirm the operability and advantage of the present invention, and the present invention is not limited to the one condition example. The present invention can employ various conditions as long as the object of the present invention is achieved without departing from the scope of the present invention.

A cold-rolled steel sheet containing Si of about 3 mass % and the balance being Fe and other impurities was prepared, a photoresist film in which the widths w1 and w2 of the steel sheet exposed portion 2, the width p of the steel sheet non-exposed portion 3, and the length s of the steel sheet exposed portion 2 were set under conditions as shown in Table 1 below was applied to the surface of the cold-rolled steel sheet.

Subsequently, to form the groove composed of the main groove and the plurality of sub-grooves branching therefrom as shown in FIG. 1, a groove was fabricated by electrolytic etching or non-electrolytic etching according to conditions shown in Table 1 so as to form main grooves at a 4 mm pitch perpendicular to the rolling direction.

In the electrolytic etching, a NaCl aqueous solution having a solution temperature of 40° C. and a concentration of 10 mass % was used as the etching solution, and a current density was set to 0.3 A/cm$^2$. Also, an electrolytic time length was changed in a range from 10 s to 500 s to adjust the groove depth as shown in Table 1. At this point, a titanium platinum sheet was used as a cathode sheet, and the cold-rolled steel sheet as a material to be etched was attached to an anode side.

Also, in the non-electrolytic etching, a $FeCl_3$ solution having a solution temperature of 50° C. and a concentration of 34 mass % was used as the etching solution. Also, an immersion time length was changed in a range from 10 min to 25 min to adjust the groove depth as shown in Table 1.

The cold-rolled steel sheet where the groove was fabricated through the above procedure was subjected to decarburization annealing and finish annealing, and was coated with an insulating film, so that a grain-oriented electrical steel sheet was obtained. An core loss value W17/50 at a frequency of 50 Hz and a magnetic flux density of 1.7 T was measured using a single-plate magnetic apparatus in the obtained grain-oriented electrical steel sheet.

TABLE 1

| Test number | Invention example 1 | Invention example 2 | Invention example 3 | Comparative example 4 | Comparative example 5 | Comparative example 6 | Invention example 7 |
|---|---|---|---|---|---|---|---|
| Distance x from a boundary between an etched portion and a non-etched portion in a steel sheet surface after etching to a boundary between a steel sheet exposed portion and a steel sheet non-exposed portion in a resist film before starting etching (μm) | 35 | 35 | 60 | 25 | 35 | — | 30 |
| Distance y from a boundary between an etched portion and a non-etched portion in a steel sheet surface after etching to a boundary between a steel sheet exposed portion and a steel sheet non-exposed portion in a resist film before starting etching (μm) | 35 | 35 | 60 | 185 | 190 | — | 28 |
| Distance z from a boundary between an etched portion and a non-etched portion in a steel sheet surface after etching to a boundary between a steel sheet exposed portion and a steel sheet non-exposed portion in a resist film before starting etching (μm) | 35 | 35 | 60 | 35 | 40 | — | 27 |
| Width W1 of a steel sheet exposed portion before starting etching (μm) | 20 | 30 | 25 | 30 | 30 | 10 | 20 |
| Width W2 of a steel sheet exposed portion before starting etching (μm) | 20 | 30 | 20 | 30 | 30 | 10 | 20 |

TABLE 1-continued

| Test number | Invention example 1 | Invention example 2 | Invention example 3 | Comparative example 4 | Comparative example 5 | Comparative example 6 | Invention example 7 |
|---|---|---|---|---|---|---|---|
| Width p of a steel sheet non-exposed portion before starting etching (μm) | 120 | 140 | 190 | 50 | 50 | 100 | 120 |
| Length s of a steel sheet exposed portion before starting etching (μm) | 150 | 150 | 150 | 150 | 150 | 150 | 160 |
| Groove depth d after etching (μm) | 15 | 15 | 20 | 15 | 18 | 0 | 15 |
| Interval a between adjacent grooves after etching (μm) | 50 | 70 | 70 | 0 | 0 | — | 60 |
| Length c of a branching groove after etching (μm) | 150 | 150 | 150 | 0 | 0 | — | 160 |
| Core loss W17/50 (W/kg) | 0.70 | 0.70 | 0.69 | 0.75 | 0.74 | 0.80 | 0.71 |
| Etching method | Electro-lytic | Non-electro-lytic | Electro-lytic | Electrolytic | Non-electrolytic | Electrolytic | Electro-lytic |

As shown in Table 1, in all of present invention examples of test nos. 1 to 3, and 7, the branching micro grooves were formed in the surface of the cold-rolled steel sheet, and a favorable core loss value W17/50 was obtained. Meanwhile, in comparative examples of test nos. 4 and 5, the width p of the steel sheet non-exposed portion of the resist film was small, so that the sub-grooves disappeared when the erosion length x reached half of the width p. As a result, the erosion length y had a value obtained by the steel sheet being further eroded by the erosion length z from the length s of the steel sheet exposed portion, and a large core loss value W17/50 was obtained.

Furthermore, in a comparative example of test no. 6, the widths w1 and w2 of the steel sheet exposed portion of the resist film were too small, the etching solution did not penetrate through the steel sheet exposed portion and the groove was not formed even when the electrolytic etching was executed. Thus, a large core loss value W17/50 was obtained.

INDUSTRIAL APPLICABILITY

As described above, the present invention can provide the grain-oriented electrical steel sheet having excellent core loss characteristics without losing the grooving effect even after the stress-relief annealing. Accordingly, the present invention is highly applicable in the industries of electrical steel sheet production and electrical steel sheet application.

The invention claimed is:

1. A method for manufacturing a grain-oriented electrical steel sheet comprising the steps of:

forming a film on one surface or both surfaces of a steel sheet; and performing etching on the steel sheet where the film is formed such that a groove depth of the steel sheet is 10 μm to 30 μm, and an erosion length of the steel sheet under the film is 2 to 4.5 times of the groove depth, wherein a steel sheet exposed portion where a portion of the steel sheet is exposed is formed in the film, and the steel sheet exposed portion has a first region oriented in a sheet width direction, and a plurality of second regions starting from the first region, widths of the first region and the second regions being 20 μm to 100 μm, and a distance from an end portion of one of the second regions to an end portion of another of the second regions adjacent thereto being 60 μm to 570 μm.

2. The method for manufacturing a grain-oriented electrical steel sheet according to claim 1, wherein the etching is electrolytic etching, the electrolytic etching being performed by using a sodium chloride aqueous solution having a concentration of 10 mass % to 20 mass % as an etching solution under such conditions that a solution temperature is 40° C. to 50° C., a current density is 0.1 A/cm$^2$ to 10 A/cm$^2$, and an electrolytic time length is 10 s to 500 s.

3. The method for manufacturing a grain-oriented electrical steel sheet according to claim 1, wherein the etching is non-electrolytic etching, the non-electrolytic etching being performed by using a ferric chloride aqueous solution having a concentration of 30 mass % to 40 mass % as an etching solution under such conditions that a solution temperature is 40° C. to 50° C., and an immersion time length is 10 min to 25 min.

* * * * *